US009375784B2

(12) United States Patent
Boorman et al.

(10) Patent No.: US 9,375,784 B2
(45) Date of Patent: Jun. 28, 2016

(54) METHOD OF FORMING SEALED REFRACTORY JOINTS IN METAL-CONTAINMENT VESSELS, AND VESSELS CONTAINING SEALED JOINTS

(75) Inventors: James E. Boorman, Greenacres, WA (US); Eric W. Reeves, Hayden Lake, ID (US); Robert Bruce Wagstaff, Greenacres, WA (US); Randy Womack, Spokane Valley, WA (US)

(73) Assignee: Novelis Inc., Atlanta, GA (US)

( * ) Notice: Subject to any disclaimer, the term of this patent is extended or adjusted under 35 U.S.C. 154(b) by 1271 days.

(21) Appl. No.: 12/928,353

(22) Filed: Dec. 8, 2010

(65) Prior Publication Data

US 2011/0139799 A1 Jun. 16, 2011

Related U.S. Application Data

(60) Provisional application No. 61/283,886, filed on Dec. 10, 2009.

(51) Int. Cl.
*B22D 35/04* (2006.01)
*B22D 11/103* (2006.01)
(Continued)

(52) U.S. Cl.
CPC ..... *B22D 35/04* (2013.01); *B22D 11/103* (2013.01); *C21B 7/06* (2013.01); *C21C 5/44* (2013.01); *F27D 3/14* (2013.01); *F27D 99/0073* (2013.01); *Y10T 156/1089* (2015.01)

(58) Field of Classification Search
CPC ..... B22D 11/103; B22D 35/00; B22D 35/04; B22D 35/06; B22D 37/00; B22D 41/005; B22D 41/02; B22D 41/023; B28B 1/002; B28B 1/008; B28B 1/16; B28B 13/022; B28B 23/02; B28B 23/18; B28B 23/22; C21B 7/04; C21B 7/06; E01F 5/005; C21C 5/44; F27D 1/0003; F27D 1/0006; F27D 1/0023; F27D 1/0026; F27D 1/145; F27D 3/14; F27D 3/145; F27D 99/0073; F27D 2099/0081
See application file for complete search history.

(56) References Cited

U.S. PATENT DOCUMENTS 1,192,178 A 7/1916 Finley
4,381,856 A * 5/1983 Inoue et al. ..... 266/281
(Continued)

FOREIGN PATENT DOCUMENTS

CA 2049471 A1 2/1992
CA 2052109 A1 4/1992
(Continued)

OTHER PUBLICATIONS

Machine Translation of JPH7-26132, Takahashi, Mar. 22, 1995,*
(Continued)

*Primary Examiner* — Alison L Hindenlang
(74) *Attorney, Agent, or Firm* — Kilpatrick Townsend & Stockton LLP

(57) ABSTRACT

An exemplary embodiment of the invention provides a method of preparing a reinforced refractory joint between refractory sections of a vessel used for containing or conveying molten metal, e.g. a metal-contacting trough. The method involves introducing a mesh body made of metal wires into a gap between metal-contacting surfaces of adjacent refractory sections of a vessel so that the mesh body is positioned beneath the metal conveying surfaces, and covering the mesh body with a layer of moldable refractory material to seal the gap between the metal-contacting surfaces. Other embodiments relate to a vessel formed by the method and a vessel section with a pre-positioned mesh body suitable for preparing a sealed joint with other such sections.

16 Claims, 5 Drawing Sheets

(51) Int. Cl.

| | |
|---|---|
| ***C21B 7/06*** | (2006.01) |
| ***C21C 5/44*** | (2006.01) |
| ***F27D 3/14*** | (2006.01) |
| ***F27D 99/00*** | (2010.01) |

(56) References Cited

U.S. PATENT DOCUMENTS

| | | | | |
|---|---|---|---|---|
| 4,571,318 | A * | 2/1986 | Dudro et al. | 264/30 |
| 4,640,848 | A * | 2/1987 | Cerdan-Diaz et al. | 427/426 |
| 5,318,279 | A * | 6/1994 | Brandy et al. | 266/275 |
| 5,673,902 | A | 10/1997 | Aubrey et al. | |
| 6,973,955 | B2 * | 12/2005 | Tingey et al. | 164/133 |
| 2008/0163999 | A1 | 7/2008 | Hymas et al. | |

FOREIGN PATENT DOCUMENTS

| | | | | |
|---|---|---|---|---|
| CN | 1894061 | | 1/2007 | |
| GB | 809976 | A | 3/1959 | |
| GB | 979267 | A | 1/1965 | |
| JP | S49007125 | | 1/1974 | |
| JP | S50043716 | | 4/1975 | |
| JP | S61164998 | U | 10/1986 | |
| JP | H02122194 | A | 5/1990 | |
| JP | H02170908 | A | 7/1990 | |
| JP | H04259315 | A | 9/1992 | |
| JP | H7-26132 | * | 3/1995 | C21B 7/10 |
| JP | H07026132 | B2 | 3/1995 | |
| JP | H0926269 | A | 1/1997 | |
| JP | 2006003040 | A | 1/2006 | |
| WO | WO 95/21273 | A1 | 8/1995 | |
| WO | WO 2006/110974 | A1 | 10/2006 | |

OTHER PUBLICATIONS

Canadian Patent Application No. 2,778,440, Office Action dated Sep. 16, 2013, 2 pages.

U.S. Appl. No. 12/928,356, filed Dec. 8, 2010, Reeves et al.

Japanese Patent Application No. 2012-542324, Second Office Action mailed Dec. 9, 2014, 2 pages.

Chinese Patent Application No. CN201080055847.X, Office Action mailed Jan. 13, 2014, 10 pages.

Canadian Intellectual Property Office, International Search Report, Aug. 3, 2011, PCT/CA2010/001939 (Novelis Inc. et al.).

European Patent Application No. 10835337.6, Extended European Search Report mailed Mar. 12, 2015, 9 pages.

Japanese Patent Application No. 2012-542324, Office Action mailed Aug. 19, 2014, 7 pages.

* cited by examiner

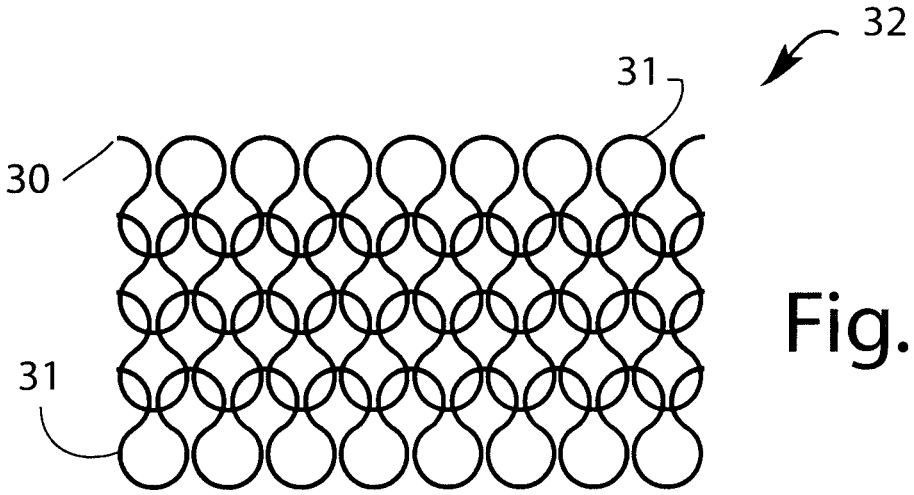
Fig. 8
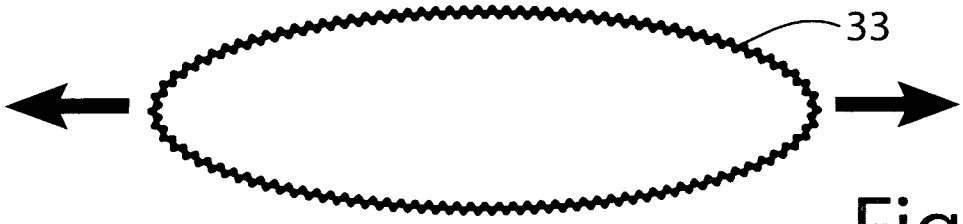
Fig. 9
Fig. 10
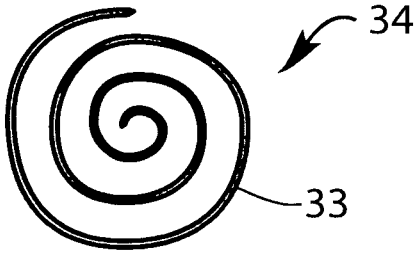
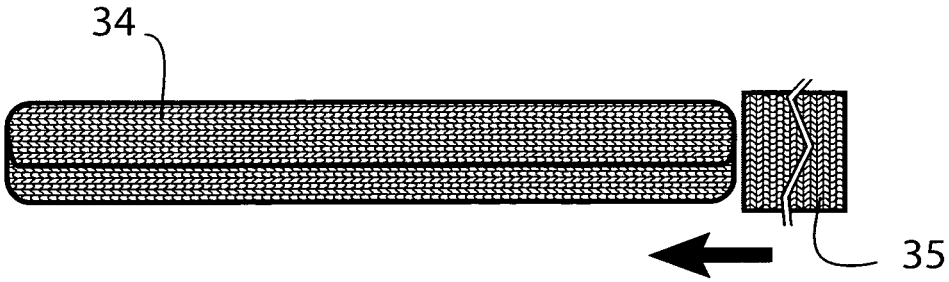
Fig. 11

METHOD OF FORMING SEALED REFRACTORY JOINTS IN METAL-CONTAINMENT VESSELS, AND VESSELS CONTAINING SEALED JOINTS

CROSS-REFERENCE TO RELATED APPLICATION

This application claims the priority right of prior U.S. provisional patent application Ser. No. 61/283,886 filed Dec. 10, 2009 by Applicants herein. The entire contents of application Ser. No. 61/283,886 are incorporated herein for all purposes by this reference.

BACKGROUND OF THE INVENTION

I. Field of the Invention

This invention relates to molten metal containment structures used for conveying, treating or holding molten metals, particularly such structures incorporating refractory or ceramic molten metal-containing vessels made from or including two or more pieces or sections. More particularly, the invention relates to methods of providing sealed joints between such pieces or sections to prevent leakage of molten metals from the vessels at the joints.

II. Background Art

Molten metal containment vessels, e.g. metal-conveying troughs and launders, are often employed during metal treatment or casting operations and the like, for example to convey molten metal from one location, such as a metal melting furnace, to another location, such as a casting mold or casting table. In other operations, such vessels are used for metal treatments, such as metal filtering, metal degassing or metal transportation. Vessels of this kind are often constructed from two or more shaped sections made of refractory and/or ceramic materials that are resistant to high temperatures and to degradation by the molten metals intended to be contained therein. The vessel sections are brought into close mutual contact and may be held within an outer metal casing or the like provided for support, proper alignment and protection against damage. Sometimes, such vessels are provided with sources of heat to ensure that the molten metals do not cool unduly or solidify as they are held within the vessels. The sources of heat may be electrical heating elements positioned above or beneath the vessels or enclosures for conveying hot fluids (e.g. combustion gases) along the inner or outer surfaces of the vessels.

It is of course important to ensure that molten metal does not leak out of the vessels at the interface between two abutting sections, whether the vessels are heated or not. However, it is especially important to avoid metal leakage when sources of heat for the vessel are provided because the molten metal may cause catastrophic damage to electrical heating elements or other heating means. It is therefore usual to provide a sealed joint between adjacent vessel sections, e.g. by providing a layer of refractory paper between the adjacent sections to accommodate thermal expansion or contraction. A refractory sealant may also be forced into the gap between abutting surfaces of adjacent sections. It is also known to provide sections with a surface groove spanning the abutting sections and to fill the groove with a refractory rope covered with a moldable refractory sealant to fill the joint and to form a smooth interconnecting surface between the vessel sections. However, all such joints deteriorate with time and use due to thermal cycling, especially when used in heated vessels, and the joints eventually allow a direct leak path to appear between the vessel sections.

There is therefore a need for further ways of providing sealed joints for metal-holding and metal-containment vessels.

SUMMARY OF THE EXEMPLARY EMBODIMENTS

An exemplary embodiment of the invention provides a method of preparing a reinforced refractory joint between refractory sections of a vessel used for containing or conveying molten metal. The method comprises introducing a mesh body made of metal wires (preferably of a metal that is resistant to attack by the molten metal contained in the vessel) into a gap between metal-contacting surfaces of adjacent refractory sections of the vessel so that the mesh body is positioned beneath the metal-contacting surfaces, and covering the mesh body with a layer of moldable refractory material (preferably in the form of a malleable paste) to seal the gap between the metal-contacting surfaces.

The mesh body forms a flexible and compressible support for the moldable refractory material. Furthermore, in case the refractory material becomes cracked or broken, the mesh body holds the pieces in place and maintains the joint seal. The mesh body preferably has mesh openings of a size (e.g. 1-5 mm, more preferably 2-3 mm) that resist penetration by the molten metal due to surface tension forces (metal meniscus or wetting angle), and also a thickness or number of layers that creates a tortuous or convoluted path for any molten metal that does penetrate the surface of the mesh body, thereby making penetration completely through the mesh body unlikely. It is also advantageous to employ a metal for the mesh body that is not easily wetted by the molten metal, i.e. it may be less than fully wetted. Although completely non-wetted metals would be desirable, they may not have the other desirable characteristics, e.g. resistance to attack by the molten metal.

Preferably, an enlarged groove is formed in or close to a metal-contacting surface of at least one of the vessel sections to form part of the gap between the adjacent the sections. Such a groove provides a positive location for the mesh body and, without such a groove, the gap between the sections has to be made large enough to provide space for the mesh body. The groove may be formed so that the sides of the groove are closer together than the diameter or width of the mesh body, whether the mesh body is used with or without impregnating refractory paste. Advantageously, the width of the groove is 0 to 15% narrower than the nominal (uncompressed) width of the mesh body prior to its insertion into the groove, although the groove may preferably have a width in a range of up to 15% wider or up to 50% narrower than the width of the mesh body (or, expressed in the alternative, the uncompressed width of the mesh body is preferably 0 to 15% wider than the width of the groove, etc.). The groove is typically incorporated into the vessel section as it is cast, or may be ground or cut into the end region of a trough section already formed, e.g. at the time of installation or repair of the vessel. The groove may be made rectangular (including square), part-circular or of any other desired profile. The groove may be located at the metal-contacting surface or beneath it buried within the gap. In the latter case, the mesh body is virtually fully enclosed within the groove on all sides, except at the gap, and the moldable refractory paste is used to seal the gap above the mesh body, but may or may not actually contact the mesh body. Moreover, the groove may be located entirely within one of the vessel sections or, alternatively, parts of the groove may be formed in both sections of an adjoining pair so that the sections line up to form the groove when the vessel is assembled.

In one embodiment, a quantity of moldable refractory material in the form of a paste is worked into the mesh body before the mesh body is introduced into the gap between the adjacent refractory sections.

According to another exemplary embodiment of the invention, there is provided a vessel for containing molten metal formed by two or more refractory vessel sections positioned end to end having a sealed joint between adjacent ends of the vessel sections. The sealed joints comprise a mesh body made of metal wires introduced into a gap between the adjacent vessel sections, and a layer of moldable refractory material overlying the mesh body in the gap and sealing the gap against molten metal penetration between the refractory sections. The mesh body itself may contain a quantity of refractory paste.

According to yet another exemplary embodiment, there is provided a vessel section for a molten metal containing vessel, the vessel section comprising a body of refractory material having a metal-conveying channel formed therein, and having a transverse groove at one end of the body, the groove having a metal mesh rope pre-positioned in the groove leaving room in the groove for an overlying coating of a moldable refractory material.

Preferably the vessel is shaped and dimensioned for use as an elongated metal-conveying trough having a channel formed therein, or as a container for a molten metal filter, a container for a molten metal degasser, a crucible, or the like.

The vessel is normally intended for containing molten aluminum and aluminum alloys, but could be used for containing other molten metals, particularly those having similar melting points to aluminum, e.g. magnesium, lead, tin and zinc (which have lower melting points than aluminum) and copper and gold (that have higher melting points than aluminum). Preferably, for a particular molten metal intended to be contained or conveyed, a metal should be chosen for the mesh that is unreactive with that particular molten metal, or that is at least sufficiently unreactive that limited contact with the molten metal would not cause excessive erosion or absorption of the mesh. Titanium is a good choice for molten aluminum, but has the disadvantage of high cost. Less expensive alternatives include, but are not limited to, Ni—Cr alloys (e.g. Inconel®) and stainless steel.

When the vessel is a trough, the trough may have an open metal-conveying channel that extends into the body of the trough or trough section from an upper surface. Alternatively, the channel may be entirely enclosed by the body, e.g. in the form of a tubular hole passing through the body of the trough from one end to the other.

Although the sealed joint of the exemplary embodiments may be formed just between metal-contacting surfaces of adjacent vessel sections, the joint may alternatively be formed between all parts of adjacent trough sections.

The sealed joint of the exemplary embodiments may be formed between vessel sections, e.g. trough sections, that are either heated or unheated. If heated trough sections are joined in this way, they may form part of a heated trough structure according to U.S. Pat. No. 6,973,955 issued to Tingey et al. on Dec. 13, 2005, or pending U.S. patent application Ser. No. 12/002,989, published on Jul. 10, 2008 under publication no. US 2008/0163999 to Hymas et al. (the disclosures of which patent and patent application are specifically incorporated herein by this reference). The patent to Tingey et al. provides electrical heating from below and from the sides, and the patent application to Hymas et al. provides heating by means of circulating combustion gases. In still further alternative embodiments, heating means may be located inside or above the refractory vessel itself.

The term "refractory material" as used herein to refer to metal containment vessels is intended to include all materials that are relatively resistant to attack by molten metals and that are capable of retaining their strength at the high temperatures contemplated for the vessels. Such materials include, but are not limited to, ceramic materials (inorganic non-metallic solids and heat-resistant glasses) and non-metals. A non-limiting list of suitable materials includes the following: the oxides of aluminum (alumina), silicon (silica, particularly fused silica), magnesium (magnesia), calcium (lime), zirconium (zirconia), boron (boron oxide); metal carbides, borides, nitrides, silicides, such as silicon carbide, particularly nitride-bonded silicon carbide ($SiC/Si_3N_4$), boron carbide, boron nitride; aluminosilicates, e.g. calcium aluminum silicate; composite materials (e.g. composites of oxides and non-oxides); glasses, including machinable glasses; mineral wools of fibers or mixtures thereof; carbon or graphite; and the like.

BRIEF DESCRIPTION OF THE DRAWINGS

FIG. 3 is top plan view of the abutting ends of two trough sections of the kind shown in FIGS. 1 and 2 having a sealed joint formed there-between;

FIG. 8 is an enlarged view of a woven mesh layer suitable for use in exemplary embodiments;

FIG. 9 is a top plan view of the woven layer of FIG. 8 showing the tubular nature of the woven layer;

FIG. 10 is an end view of a rolled-up bundle formed from the tubular woven piece of FIGS. 8 and 9; and FIG. 11 is a side view of the bundle of FIG. 10 showing how the bundle may be covered by a tubular woven sleeve to keep the bundle together and form a flexible rope.

DETAILED DESCRIPTION OF THE EXEMPLARY EMBODIMENTS

Figure 1:
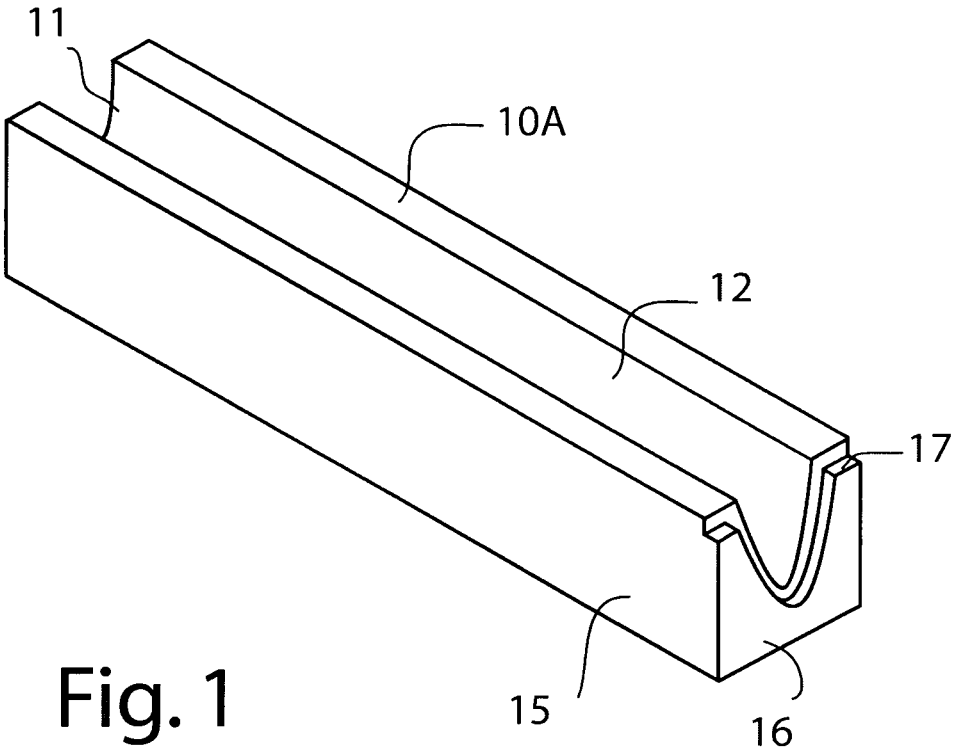
FIG. 1 is a perspective view of a refractory trough section having a groove at one end suitable for forming a sealed joint.
Figure 2:
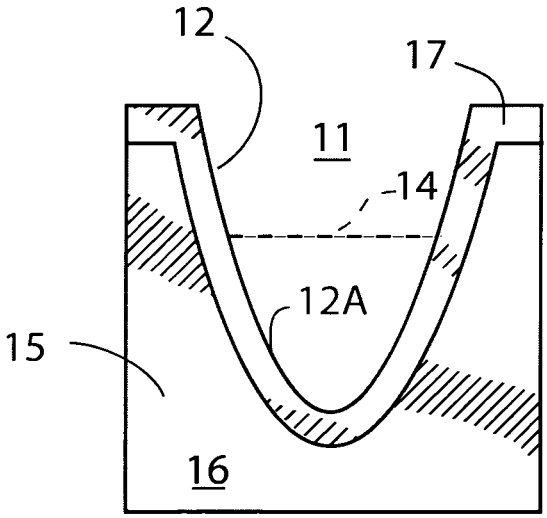
FIG. 2 is an end view of the trough section of FIG. 1 showing the end having the groove formed therein.
Figure 3:
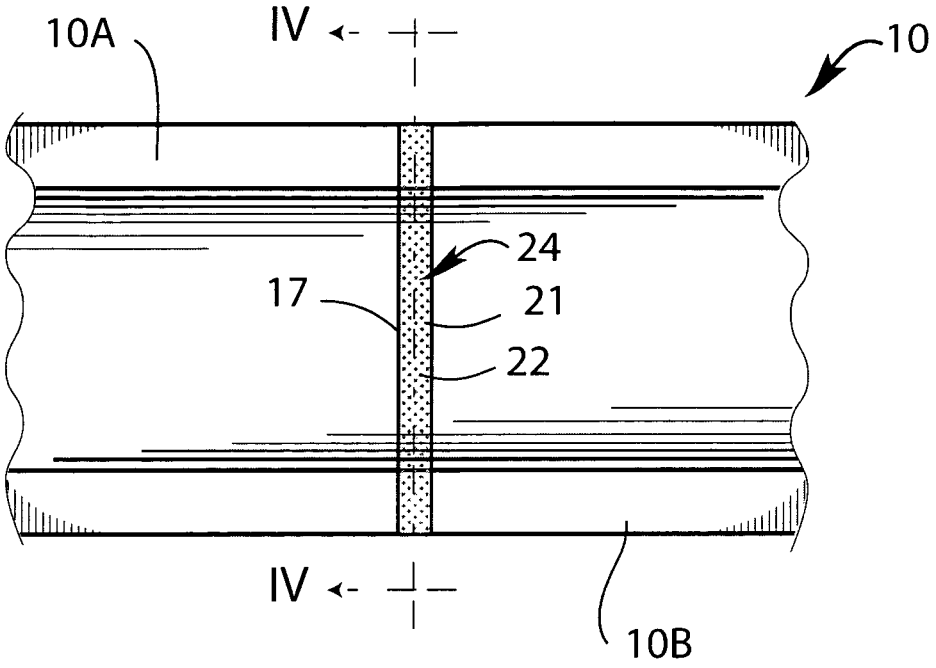

FIGS. 1 and 2 of the accompanying drawings show one section 10A of a molten metal-containment vessel in the form of an elongated metal-conveying trough 10 (see FIG. 3). The trough 10 is formed by positioning two or more such sections end to end to create a trough of any desired length. Although not shown in these views, the sections are normally held within an open-topped metal casing of a molten metal containment or distribution structure, so that the sections are held by the casing against relative movement and are protected from damage. The section 10A has a U-shaped channel 11 formed by an inner channel surface 12. In use, the channel 11 is partially filled with molten metal up to a maximum level 14 (FIG. 2) as the molten metal is conveyed through the trough.

The parts 12A of the surface 12 below the level 14 are thus in contact with molten metal during use of the apparatus and form molten metal-contacting surfaces. The trough section is formed by a body 15 which is a solid cast block of refractory material having resistance to both heat and attack by molten metal. For example, the body may be made of any one of the refractory materials exemplified earlier provided they may be shaped and formed into a suitable vessel section. Particularly preferred are alumina, silicon carbide, nitride-bonded silicon carbide (NBCS), fused silica, and combinations of these materials. One longitudinal end 16 of the trough section is provided with an enlarged groove 17 of rectangular cross-section that extends into the body 15 of the trough section from the inner surface 12 and runs completely from one side of the trough section to the other. When two such trough sections are placed in longitudinal alignment, with one grooved end adjacent to a non-grooved end, the groove 17 is closed on all sides except at the inner surface 12. As an alternative, each end of the trough section 10 may be provided with a half-width groove so that a groove 17 of full width is formed between such trough sections when the grooved ends are positioned together. This latter alternative has the advantage that the remainder of the gap between trough sections (i.e. the part below the groove 17) is positioned immediately under the centerline of the groove, rather than at one side thereof, and is therefore more protected against leakage for reasons that will become apparent below.

Figure 4:
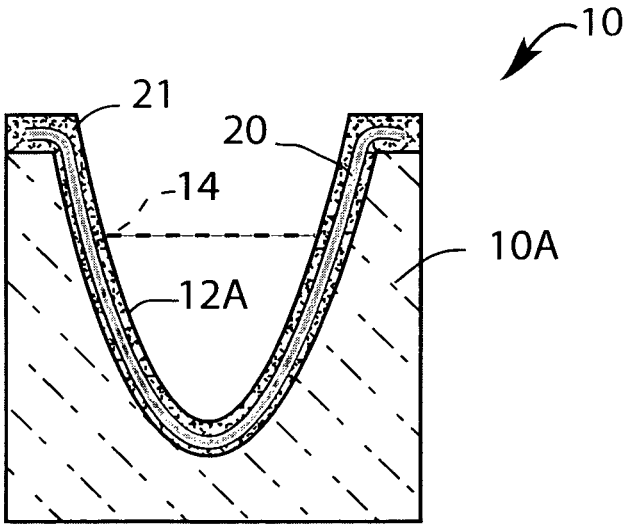
FIG. 4 is a transverse cross-section of the sealed joint of FIG. 3 taken on the line IV-IV showing the internal construction of the joint.

FIGS. 3 and 4 show adjoining parts of two trough sections 10A and 10B. These sections are positioned end to end and are provided with a sealed joint 24 according to one preferred exemplary embodiment. FIG. 3 is a plan view from the top and FIG. 4 is a cross-section along the line IV-IV of FIG. 3. Rectangular groove 17 is filled with and sealed by a combination of a metal mesh body in the form of a flexible, compressible rope 20, and a moldable refractory paste 21. A smooth surface 22 is preferably formed from paste 21 at the outer surface of the groove 17, at least in the region of the surface part 12A of the trough section that contacts molten metal during use. This assures a smooth laminar flow of metal over sealed joint 24 and thereby reduces erosion.

Figure 5:
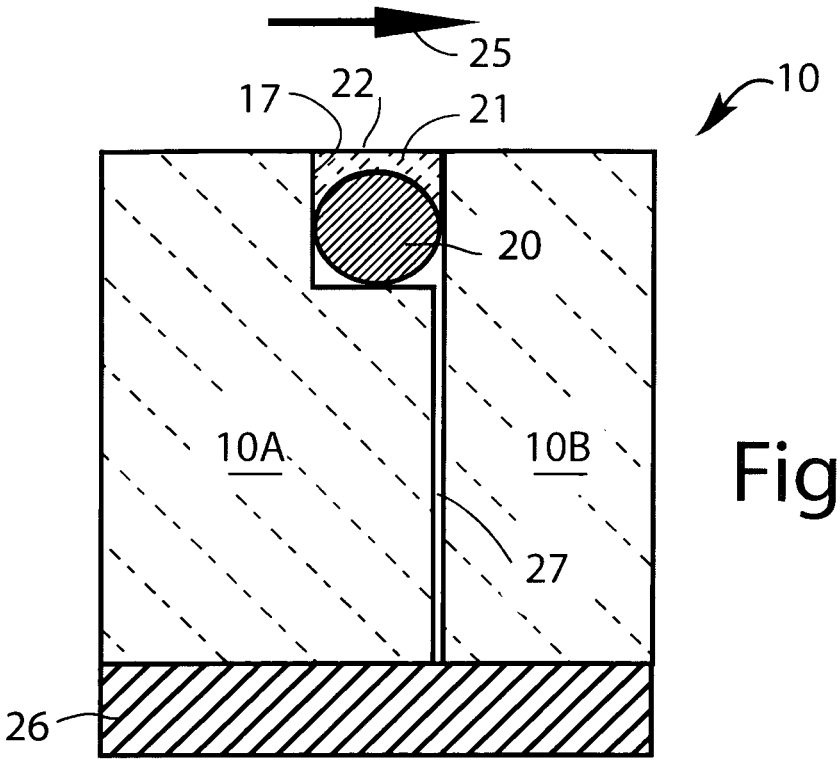
FIG. 5 is a longitudinal cross-section of one type of sealed joint formed between adjacent trough sections.
Figure 6:
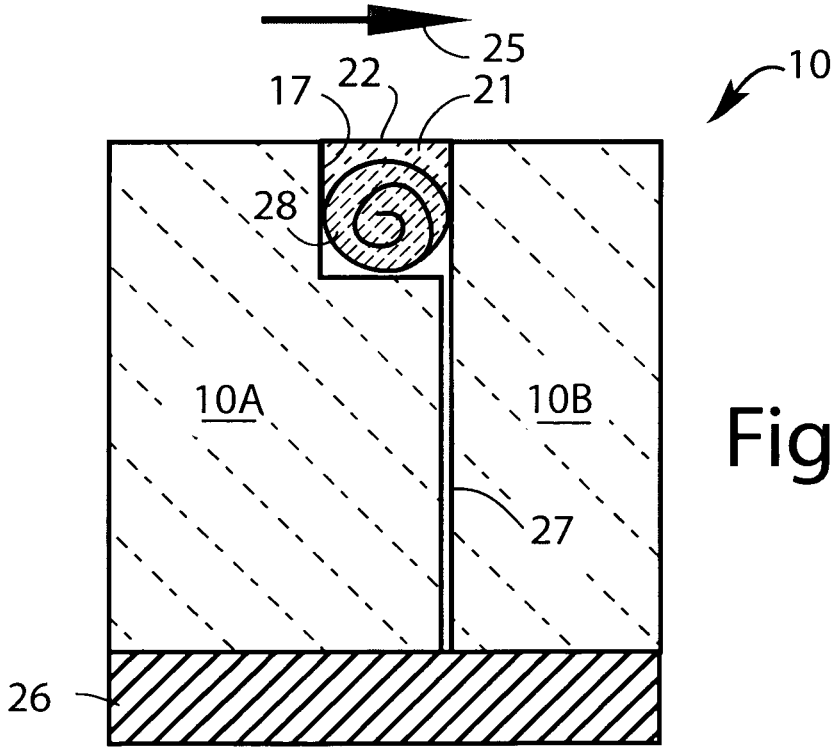
FIG. 6 is a longitudinal cross-section similar to that of FIG. 5 but showing an alternative type of joint formed between adjacent trough sections.
Figure 7:
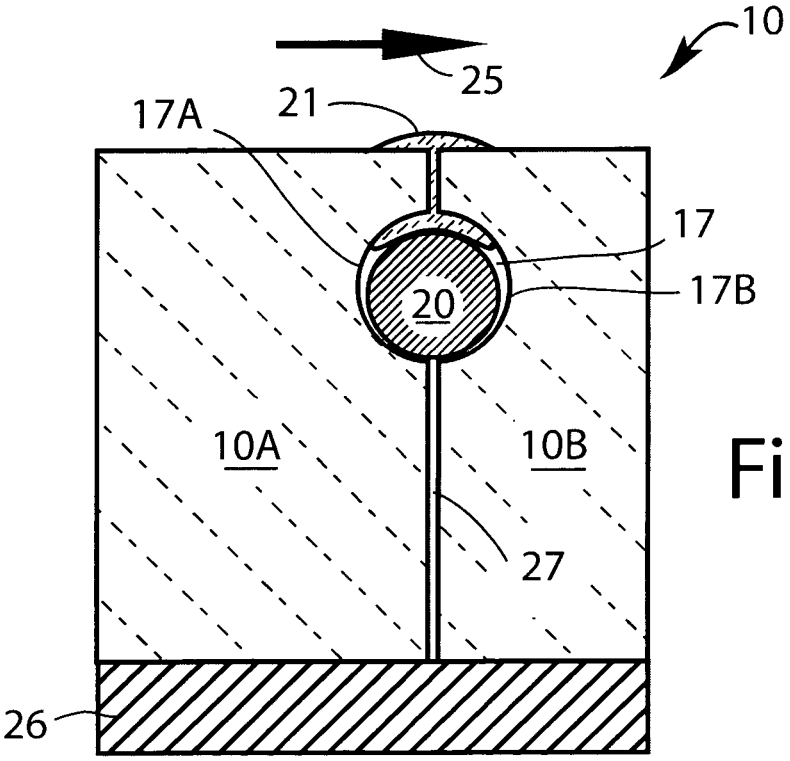
FIG. 7 is a longitudinal cross-section similar to that of FIG. 5 but showing a further alternative type of joint formed between adjacent trough sections.

Examples of different ways in which the joint can be formed are illustrated in FIGS. 5, 6 and 7. As shown in FIG. 5, metal mesh rope 20 is first inserted into the groove 17 and pushed to the bottom of the groove, for example by means of a hand-tool such as a blunt chisel or thin tamping device (not shown). The metal mesh rope 20 is then covered by a layer of the moldable refractory material 21 pushed into the groove and made smooth at surface 22 by means of a hand-tool such as a trowel (not shown). The metal mesh of the rope should preferably not be exposed at the surface 22 and is preferably covered by a layer of the refractory paste having a thickness of up to 1.9 cm (¾ inch). The moldable refractory material 21 is then allowed to dry, harden and possibly cure before the trough sections are used to convey molten metal (as represented by arrow 25). The trough sections 10A and 10B are supported above an electrical heating element 26 within an outer metal casing (not shown), although heating elements of the same kind may alternatively or additionally be provided along the sides of the trough section. The metal mesh rope 20 extends horizontally completely across the groove 17, as does the moldable refractory material 21, so that molten metal cannot penetrate into the groove 17 and down into the gap 27 between the adjacent trough sections 10A and 10B. The heating element 26 is therefore protected from contact with molten metal from the interior of the trough and is thus protected from damage and degradation by the metal. The moldable refractory material 21 adheres to the metal mesh rope 20 as it dries and cures so that the metal mesh provides a durable support and reinforcement for the moldable refractory material 21. This allows the use of a softer and more flexible moldable refractory material than would be the case if the groove had to be filled solely with a moldable refractory material itself. The metal mesh also allows the sealed joint 24 to expand and contract with heating cycles and also allows the moldable refractory material 21 to expand and contract in the same way, thus minimizing the likelihood of cracking. However, should the moldable refractory material 21 develop a crack or fissure, molten metal from the trough section will not penetrate far into the groove 17 because the metal mesh body of the rope 20 resists such penetration, especially if the mesh size of the metal mesh is relatively small, e.g. 1-5 mm and more preferably 2-3 mm, or smaller, so that the molten metal meniscus bridges the mesh openings and resists metal penetration. Penetration is also discouraged if the body is made up of two or more layers so that a tortuous or convoluted path through the body must be taken by the molten metal if it is to fully penetrate the rope 20.

In the embodiment of FIG. 6, the metal mesh rope 20 is first impregnated with a moldable refractory paste material 28, which may be the same as or different from the moldable refractory material 21 employed above the rope. The impregnation of the paste into the metal mesh rope can be done, for example, by providing a flat strip of woven mesh material, working the moldable refractory paste 28 into the mesh openings, and then rolling the flat strip into a roll to form the rope 20. The refractory-impregnated rope is then used in the same way as that of FIG. 5 to form a sealed joint 24. The refractory paste impregnated into the rope in the embodiment of FIG. 6 introduces more refractory material into the joint, and allows for better adhesion of the rope with the moldable refractory 21 and also with the sides and the bottom of the groove 17. In both embodiments of FIGS. 5 and 6, an amount of moldable refractory material may, if desired, be worked into the groove 17 before the rope 20 is inserted in order to provide a layer of refractory material beneath the rope 20. While such an arrangement is not shown in FIGS. 5 and 6, it is illustrated in FIG. 4.

A further exemplary embodiment is shown in FIG. 7. In this embodiment, a groove 17 is formed by two semi-cylindrical depressions 17A and 17B formed, respectively, in end faces of trough sections 10A and 10B. The rope 20 is inserted into the groove 17 when the trough 10 is assembled from sections 10A and 10B, and it is almost completely enclosed within the bodies of the trough sections, except for the gap 27 between the trough sections (which is preferably kept as small as possible). The gap above the groove is then filled with a moldable refractory material 21. Preferably, the refractory material is made to penetrate deeply into the gap to enter the groove 17 and contact the metal mesh rope 20, at least at the top thereof. However, the refractory material may merely fill the gap above the groove 17, thus sealing the trough against metal penetration. By locating the groove 17 below the metal-contacting surfaces of the trough sections, the gap required to be filled with the refractory paste is minimized and cracks are less likely to develop and to propagate through this material. Any molten metal that does penetrate into the groove 17 has to pass through the rope 20 before it reaches the lower parts of gap 27 and, as indicated above, the characteristics of the rope make such penetration difficult and unlikely.

The metal mesh rope 20 may be any kind of metal mesh piece or body, but is preferably of a kind as shown in FIGS. 8 to 11 of the accompanying drawings. A thin flexible metal wire 30 may be woven to form an open-weave fabric using a simple warp and weft arranged at right angles, but is preferably woven with open circular loops 31 as shown in FIG. 8 to form a woven piece 32. The woven piece may be made with any suitable dimensions, but is preferably woven in the form of a tube 33 as shown in FIG. 9 of any suitable axial length between the open ends of the tube. The woven tube may then be flattened as represented by the arrows in FIG. 9, and then, starting from one open end of the flattened tube, the woven piece may be rolled up to form a tubular bundle 34 as shown in FIG. 10 (although the winding of the tubular bundle is generally much tighter than illustrated). If still greater bulk is required, two or more flattened woven tubes may be wound together to form the bundle. As shown in FIG. 11, the tubular bundle 34 is preferably covered by a tubular woven metal sleeve 35 to hold the bundle together and to form the rope 20 used in the manner shown in the earlier embodiments, e.g. as shown in FIG. 5. A rope of this kind preferably has a thickness (diameter) of 5 mm to 1.9 cm (3/16 inch to ¾ inch). The woven tubular sleeve 35 preferably has mesh openings of the same size or smaller than those of the layers forming the tubular bundle 34. The tubular sleeve 35 prevents the bundle 34 from unrolling but maintains the flexible nature of the bundle. If a rope 20 of the kind shown in FIG. 6 is required, i.e. a rope impregnated with moldable refractory paste, the bundle 34 of FIG. 10 may be unrolled and the moldable refractory paste worked into the mesh. The bundle may then be re-rolled and used in this form, or even with the outer sleeve 35 re-applied (if the greater dimension resulting from the included moldable refractory paste permits such re-use). Woven metal products of this kind may be obtained, for example, from Davlyn corporation of Spring City, Pa. 19475, USA. A particularly preferred product from Davlyn is a 1 cm (⅜ inch) flexible mesh cable having a construction similar to that shown in FIGS. 8 to 11. The wire is made of Inconel®, which is an Ni—Cr based alloy. This alloy is particularly resistant to high temperatures and is especially suitable for sealing the joints of externally-heated trough sections designed to reach high temperatures, e.g. up to about 900° C. There is also a version of the product that is made of stainless steel, which is more suitable for unheated troughs where the only source of heat is the molten metal itself.

The moldable refractory paste 21 used in the exemplary embodiments may be any kind of paste made of a refractory material that hardens and is resistant to attack and abrasion by molten metal. The paste may be, for example, a commercially available product commonly used for refractory repair, e.g. an alumina/silica paste such as Pyroform EZ Fill® sold by Rex Materials Group of P.O. Box 980, 5600 E. Grand River Ave., Fowlerville, Mich. 48836, U.S.A., or a paste containing aluminosilicate fibers such as Fiberfrax LDS Pumpable® sold by Unifrax LLC, Corporate Headquarters, 2351 Whirlpool Street, Niagara Falls, N.Y., U.S.A. Such materials should be used according to the manufacturers' instructions, and are generally cured with an external added heat source (such as a gas burner) or by using the heat provided by the trough itself when put into use. The EZ fill product cures to form a solid and relatively brittle final mass, but the metal mesh body prevents the mass from forming a continuous crack all the way through the joint. The LDS Pumpable material cures to form a more fibrous and flexible mass and the metal mesh body helps it to retain sufficient solidity to resist erosion by the molten metal. The softness of the mass allows it to accommodate some of the thermal expansion and contraction of the trough. While the above materials are preferred, pastes of any of the refractory materials exemplified earlier may be use when the can be obtained in moldable paste form.

When sealed joints are formed according to the methods of the exemplary embodiments, the joints can be easily removed by breaking through the upper layer of molded refractory material and then removing the metal mesh rope filling. This allows a trough section, even a central section, to be removed from an operational trough when necessary for maintenance or repair. The trough section may then be returned to the trough or replaced and the joint re-formed in the indicated manner.

It is also possible to pre-prepare trough sections with metal mesh ropes installed in end grooves and held in place, e.g. by means of a thin underlayer of moldable refractory paste. When such a trough section is used, it may simply be positioned end to end with other trough sections and then the joints completed by filling them in with the moldable refractory paste and smoothing off the joint surface.

In the above embodiments, the trough 10 may be an elongated molten metal trough of the kind used in molten metal distribution systems suitable for conveying molten metal from one location (e.g. a metal melting furnace) to another location (e.g. a casting mold or casting table). However, according to other exemplary embodiments, other kinds of metal containment and distribution vessels may employed, e.g. as in-line ceramic filters (e.g. ceramic foam filters) used for filtering particulates out of a molten metal stream as it flows, for example, from a metal melting furnace to a casting table. In such cases, the vessel includes a channel for conveying molten metal and a filter positioned in the channel. Examples of such vessels and molten metal containment systems are disclosed in U.S. Pat. No. 5,673,902 which issued to Aubrey et al. on Oct. 7, 1997, and PCT publication no. WO 2006/110974 A1 published on Oct. 26, 2006. The disclosures of the aforesaid U.S. patent and PCT publication are specifically incorporated herein by this reference.

In another exemplary embodiment, the vessel acts as a container in which molten metal is degassed, e.g. as in a so-called "Alcan compact metal degasser" as disclosed in PCT patent publication WO 95/21273 published on Aug. 10, 1995 (the disclosure of which is incorporated herein by reference). The degassing operation removes hydrogen and other impurities from a molten metal stream as it travels from a furnace to a casting table. Such a vessel includes an internal volume for molten metal containment into which rotatable degasser impellers project from above. The vessel may be used for batch processing, or it may be part of a metal distribution system attached to metal conveying vessels. In general, the vessel may be any refractory metal containment vessel positioned within a metal casing. The vessel may also be designed as a refractory ceramic crucible for containing large bodies of molten metal for transport from one location to another. All such alternative vessels may be used with the exemplary embodiments of the invention provided they are made of two or more sections that are joined end-to-end.

What is claimed is:

1. A method of preparing a reinforced refractory joint between refractory sections of a vessel used for containing molten metal, the method comprising: introducing a mesh body made of metal wires into a gap between molten metal-contacting surfaces of adjacent refractory sections of a molten metal containing vessel so that the mesh body is positioned beneath the molten metal-contacting surfaces and located in an enlarged groove of one of the adjacent refractory sections, and covering the mesh body with a layer of moldable refractory material to seal the gap between the molten metal-contacting surfaces.

2. The method of claim 1, wherein a quantity of moldable refractory material is worked into the mesh body before the mesh body is introduced into the gap between the adjacent refractory sections.

3. The method of claim 1, wherein the metal used to form the mesh body is a metal resistant to attack by molten metal.

4. The method of claim 1, wherein the metal used to form the mesh body is a metal chosen from the group consisting of Ni—Cr based alloys, stainless steel and titanium.

5. The method of claim 1, wherein the metal wires are woven together to form a woven metal fabric for the mesh body.

6. The method of claim 5, wherein the woven metal fabric has mesh openings having dimensions small enough to resist penetration by the molten metal.

7. The method of claim 5, wherein the mesh openings have a size in a range of 1 to 5 mm.

8. The method of claim 5, wherein the mesh openings have a size in a range of 2 to 3 mm.

9. The method of claim 1, wherein the mesh body has a plurality of layers laid one over another.

10. The method of claim 9, wherein the layers of woven metal mesh are rolled up over each other to form a flexible elongated rope.

11. The method of claim 10, wherein the flexible elongated rope is covered with a woven tubular sleeve made of metal wires.

12. The method of claim 11, wherein the woven tubular sleeve has mesh openings of the same or smaller size than the mesh openings of the one or more layers.

13. The method of claim 1, wherein the moldable refractory material is selected from the group consisting of materials made of silica/alumina and pastes containing aluminosilicate fibers.

14. The method of claim 1, wherein the enlarged groove is formed in at least one of the refractory sections adjacent the gap, and wherein the enlarged groove is located beneath the molten metal-contacting surface.

15. The method of claim 1, wherein the mesh body is chosen to have an uncompressed width wider than a width of the enlarged groove.

16. The method of claim 1, wherein the vessel is shaped and dimensioned for use as a vessel selected from the group consisting of an elongated metal-contacting trough having a channel therein, a container for a molten metal filter, a container for a molten metal degasser, and a crucible.

* * * * *